United States Patent [19]

Williams

[11] 4,067,522

[45] Jan. 10, 1978

[54] RAILROAD SAFETY AND WARNING ARRANGEMENT

[76] Inventor: Orie L. Williams, P.O. Box 482, Mount Pleasant Road, Evansville, Ind. 47711

[21] Appl. No.: 782,889

[22] Filed: Mar. 30, 1977

[51] Int. Cl.[2] ..... B61L 29/24

[52] U.S. Cl. ..... 246/1 C; 200/86.5; 200/153 C; 246/489; 340/47; 340/328

[58] Field of Search ..... 246/1 R, 1 C, 489, 292, 246/295, 167 A; 340/47, 328, 384 R; 200/86.5, 153 C

[56] References Cited

U.S. PATENT DOCUMENTS

| | | | |
|---|---|---|---|
| 1,521,793 | 1/1925 | Roe | 200/86.5 |
| 3,467,798 | 9/1969 | Krieger | 200/86.5 |

*Primary Examiner*—George E. A. Halvosa
*Assistant Examiner*—Reinhard J. Eisenzopf
*Attorney, Agent, or Firm*—Warren D. Flackbert

[57] ABSTRACT

A railroad safety and warning arrangement characterized by a single foot pedal which initiates the consecutive operation of a locomotive bell and both the locomotive bell and a locomotive whistle. The operation of the preceding alarms are discontinued by means of a release mechanism which selectively disengages a notched control arm from a side edge of the foot pedal.

6 Claims, 8 Drawing Figures

RAILROAD SAFETY AND WARNING ARRANGEMENT

As is known, a high degree of safety is demanded in the operation of a railroad. In this connection, and by way of example, fixed signals and/or signal lights, as well as movable gates, are provided at many intersections of streets or roads with a railroad track(s). Additionally, each locomotive is provided with audible signaling devices, such as a bell and a whistle.

As to the latter, an objection to the arrangement currently in use is that the bell is operated through the use of a simple hand valve which is typically mounted at a low position in the cab adjacent the engineer, where the whistle, operated by a hand lever, is mounted at a high position in the cab. In other words, use of either the bell or whistle requires a single hand of the engineer, but in the instance of a high emergency situation, i.e. when both the bell and whistle are needed, both hands of the engineer are required. The latter is particularly difficult when the engineer still wants to maintain signaling, but must relocate within the cab for reasons of personal safety.

The invention overcomes the preceding difficulty by providing a bell and whistle arrangement which is operated by means of a foot pedal. As the foot pedal is depressed, operation of the bell is first initiated, followed by operation of the bell and the whistle.

The preceding is further accomplished by means of a pivotal control arm which engages a side edge of the foot pedal. The control arm is notched, a first notch representing the bell operation, and a second notch representing the bell as well as whistle operation. The notches provide alarm functioning without the necessity of further foot pressure, unless, of course, it is desired to advance from one notch to another. The control arm is normally biased into a latching or engaging relationship with the foot pedal, where a release mechanism is provided to return the foot pedal to a non-signaling position.

The invention is readily located on the floor of the locomotive cab in front of the engineer, such being operable with conventional bell and whistle valves. The overall geometry of the unit involves the length of each plunger operating the bell valve and the whistle valve, and the placement of the notches on the control arm.

In any event, a better understanding of the present invention will become more apparent from the following description, taken in conjunction with the accompanying drawings, wherein FIG. 1 is a top plan view, partly broken away, showing a railroad safety and warning arrangement in accordance with the teachings of the invention;

Figure 1:
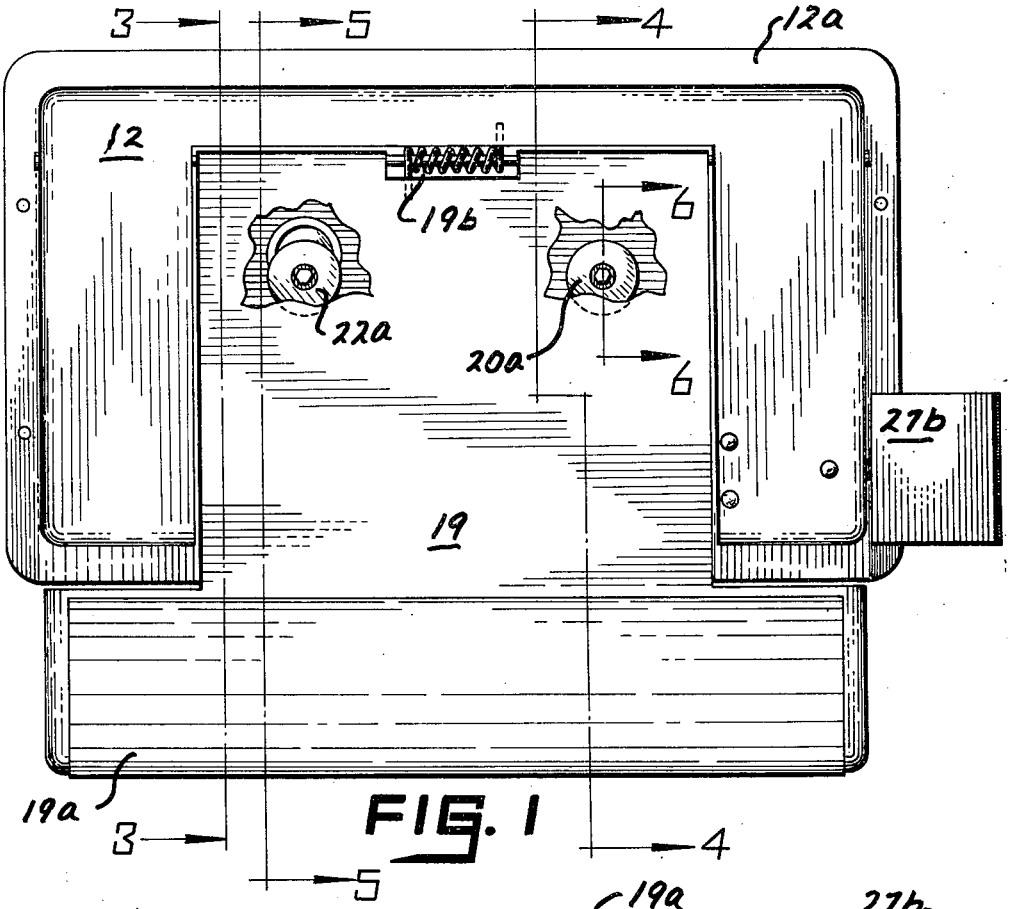

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Figure 2:
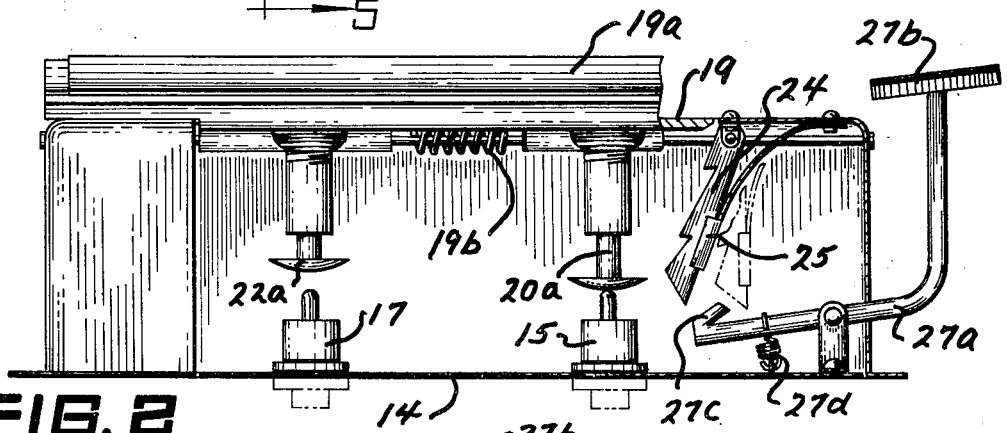
FIG. 2 is a view in front elevation, partly fragmentary, of the present invention, looking from the bottom to the top in FIG. 1.
Figure 3:
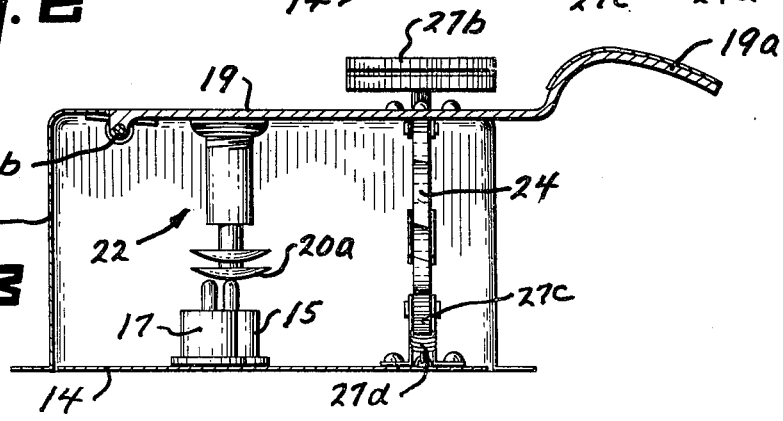
FIG. 3 is a view in vertical section, taken at line 3—3 in FIG. 1 and looking in the direction of the arrows.
Figure 4:
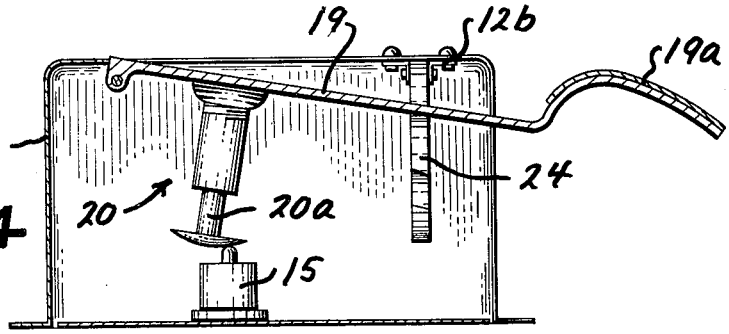
FIG. 4 is another view in vertical section, taken at line 4—4 in FIG. 1 and looking in the direction of the arrows, showing the bell valve control assembly when the foot pedal is at a first locked position.
Figure 5:
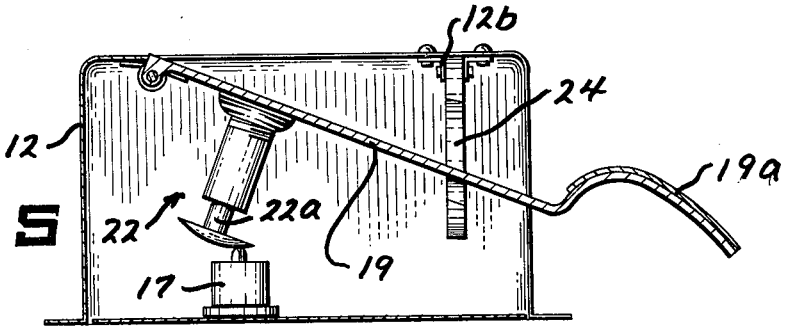
FIG. 5 is a further view in vertical section, in this instance taken at line 5—5 in FIG. 1 and looking in the direction of the arrows, showing the whistle valve control assembly when the foot pedal is at a second locked position.

Referring now to the figures, and particularly to FIGS. 1, 2 and 3, the railroad safety and warning arrangement of the invention comprises a housing 12 which typically surrounds a floor plate 14. The housing 12 has an outwardly extending flange **12*a*, where threaded means (not shown) serve to secure the housing 12 onto flooring. The floor plate 14 receives a conventional bell valve 15 and whistle valve 17**, each of the preceding forming a part of a system connecting to audible bell and whistle signaling means.

A foot pedal 19 is pivotally mounted in a cut-out portion of the upper surface of the housing 12, such foot pedal 19 having an upwardly and downwardly extending front portion **19*a* for ready engagement and movement by a foot of the engineer. A torsion spring 19*b* serves to urge the foot pedal 19 into the position of FIG. 3. As a matter of proportioning, the height of the housing 12** may be in the order of 3 to 4 inches.

Figure 6:
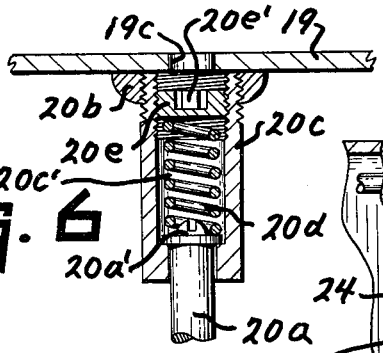
FIG. 6 is an enlarged view in vertical section showing certain details of the bell valve control assembly, taken at line 6—6 in FIG. 1 and looking in the direction of the arrows.

The undersurface of the foot pedal 19 mounts the adjustable plungers **20*a* and 22*a* of, respectively, bell control valve assembly 20 and whistle control valve assembly 22. As more particularly shown in FIG. 6, and also representative of plunger 22*a*, the plunger 20*a* for the bell control valve assembly 20 includes a collar 20*b* secured to the undersurface of the foot pedal 19. A sleeve 20*c* is threadedly received within the collar 20*b*. The sleeve 20*c* has an axial passageway 20*c*′ for receiving an end 20*a*′ of plunger 20*a*, a compression spring 20*d*, and a plug 20*e*. The latter is threadedly received along a portion of the inner wall of the sleeve 20*c***.

An opening **19*c* is provided in the foot pedal 19 to receive a wrench (not shown) which cooperates with a complementary opening 20*e*′ in the plug 20*e*. In other words, by rotating the plug 20*e*, by the wrench, the tension of compression spring 20*d*** can be readily adjusted to assure proper operation of the arrangement.

Figure 7:
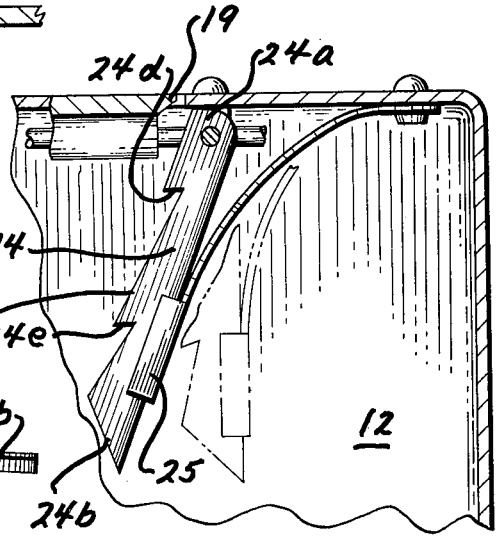
FIG. 7 is an enlarged view detailing the pivotal control arm.

With particular reference to FIGS. 2 and 7, a control arm 24 is pivotally mounted on brackets **12*b* extending downwardly from the undersurface of the housing 12. The control arm 24 has an upper end 24*a* which is partially flattened or straight, serving to limit the pivotal movement thereof. The lower end 24*b* of the control arm 24 is beveled. A spring 25, also secured to the undersurface of the housing 12, bears upon the control arm 24, continually urging the control arm 24 from the broken line position of FIG. 7** to the full line position of such figure.

The control arm 24 is further defined by a first notch 24*d* and a second notch 24*e* along an edge 24*c* thereof. The edge 24*c* selectively engages a side edge of the foot pedal 19 by reason of spring 25 and the downward movement of the foot pedal 19. In other words, the control arm 24 moves in a counterclockwise direction as the foot pedal 19 is depressed.

As will be understood, the movement of the foot pedal 19 from the position of FIG. 2 to the first notch 24*d* of the control arm 24 represents bell signaling operation. When the edge of the foot pedal 19 is lodged in the first notch 24*d*, the bell continues to operate. Depression of the foot pedal 19 from the first notch 24*d* to the second notch 24*e* also causes the simultaneous operation of the whistle. When the second notch 24*e* is reached, both the bell and the whistle continue to operate simultaneously without any need for foot pressure.

The arrangement includes a release mechanism 27 (see FIGS. 2 and 8) which permits the control arm 24 to return to the full line position of FIG. 2. The release mechanism 27 is defined by a shaft 27*a* having a foot receiving surface 27*b* at one end thereof and an angled opposite end 27*c*, the latter selectively engaging the beveled lower end 24*b* of the control arm 24. A spring 27*d* normally biases the shaft 27*a* to the position of FIG. 2.

Figure 8:
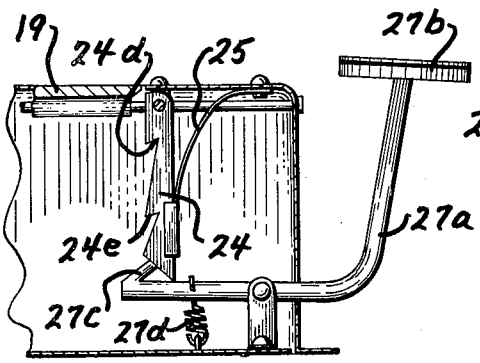
FIG. 8 is a view in elevation showing the pivotal control arm at a position immediately after the engineer's foot has been removed from the release mechanism.

When it is desired to discontinue one or both audible alarms, and assuming that the control arm 24 is at the phantom line position of FIG. 2, i.e. a side edge of the foot pedal 19 is in the second notch 24*e*, pressure on the foot receiving surface 27*b* achieves counterclockwise rotation of the control arm 24 to a position somewhat to the right of the phantom line position of FIG. 2. As a result, and because of torsion spring 19*b*, the foot pedal 19 pivots upwardly to assume the position of FIGS. 2 and 3, being limited by a stop (not shown) extending from the undersurface thereof. At the same time the engineer's foot is removed from the foot receiving surface 27*b*, as generally depicted in FIG. 8, the shaft 27*a* rotates by reason of spring 27*d*. At this time, the control arm 24 is then free to move clockwise to the full line position of FIG. 2, where spring 25 urges such movement.

From the preceding, it should be evident that the invention affords an effective safety and warning arrangement for railroad usages. The invention is operable through foot pressure, where two signaling functions are achieved, i.e. audible bell and whistle alarms. Additionally, the invention frees the hands of the engineer for other purposes.

In any event, the safety and warning arrangement described above is susceptible to various changes within the spirit of the invention, as for example, the overall proportioning of the housing, the particular manner of releasing the foot pedal from a signaling position, and the like. Thus, the preceding should be considered illustrative and not as limiting the scope of the following claims:

I claim:

1. A railroad safety and warning arrangement comprising a housing supporting a pivotal foot pedal, a first signaling mechanism and a second signaling mechanism operatively responsive to movement of said foot pedal, means maintaining the foot pedal at a first position for operation of said first signaling mechanism and maintaining the foot pedal at a second position for simultaneous operation of said first signaling mechanism and said second signaling mechanism.

2. The railroad safety and warning arrangement of claim 1 where said first signaling mechanism is a bell and where said second signaling mechanism is a whistle.

3. The railroad safety and warning arrangement of claim 1 where said foot pedal selectively engages a valve for said first signaling mechanism and a valve for said second signaling mechanism.

4. The railroad safety and warning arrangement of claim 1 where said means is a pivotal control arm normally biased into engagement with an edge of said foot pedal, and where said first position is defined by a notch in said control arm and where said second position is defined by another notch in said control arm.

5. The railroad safety and warning arrangement of claim 4 where means are provided for releasing said control arm from engagement with said foot pedal.

6. The railroad safety and warning arrangement of claim 5 where spring means urge said foot pedal upwardly upon release of said control arm.

* * * * *